US011117396B2

(12) United States Patent
Profaca

(10) Patent No.: US 11,117,396 B2
(45) **Date of Patent: *Sep. 14, 2021**

(54) SPITTOON AND METHOD FOR GUIDING PRINT MEDIA THROUGH PRINT ZONE

(71) Applicant: MEMJET TECHNOLOGY LIMITED, Dublin (IE)

(72) Inventor: Mark Profaca, North Ryde (AU)

(73) Assignee: Memjet Technology Limited

( * ) Notice: Subject to any disclaimer, the term of this patent is extended or adjusted under 35 U.S.C. 154(b) by 0 days.

This patent is subject to a terminal disclaimer.

(21) Appl. No.: 16/864,976

(22) Filed: May 1, 2020

(65) Prior Publication Data

US 2020/0254788 A1 Aug. 13, 2020

Related U.S. Application Data

(63) Continuation of application No. 16/141,894, filed on Sep. 25, 2018, now Pat. No. 10,675,891.

(60) Provisional application No. 62/563,584, filed on Sep. 26, 2017.

(51) Int. Cl.

| | |
|---|---|
| ***B41J 11/00*** | (2006.01) |
| ***B41J 2/165*** | (2006.01) |
| ***B41J 29/02*** | (2006.01) |
| ***B41J 2/155*** | (2006.01) |
| ***B41J 25/304*** | (2006.01) |
| ***B41J 2/175*** | (2006.01) |

(52) U.S. Cl.

CPC ..... *B41J 11/0045* (2013.01); *B41J 2/155* (2013.01); *B41J 2/165* (2013.01); *B41J 2/16505* (2013.01); *B41J 2/16535* (2013.01); *B41J 2/17523* (2013.01); *B41J 25/304* (2013.01); *B41J 29/02* (2013.01); *B41J 2002/16582* (2013.01)

(58) Field of Classification Search

CPC .. B41J 11/0045; B41J 2/17523; B41J 25/304; B41J 29/02; B41J 2/155; B41J 2/16505; B41J 2/16535; B41J 2/165; B41J 2002/16582

USPC ..... 347/29

See application file for complete search history.

*Primary Examiner* — Huan H Tran
*Assistant Examiner* — Alexander D Shenderov
(74) *Attorney, Agent, or Firm* — Cooley LLP

(57) ABSTRACT

A print engine includes: a media support chassis having a plurality of guide rollers mounted between opposite sidewalls thereof, the plurality of guide rollers defining a curved media feed path; a plurality of spittoons, each spittoon being positioned between a neighboring pair of guide rollers and each spittoon having an upper guide portion; and a plurality of printheads, each printhead opposing a respective spittoon. The upper guide portion of each spittoon has an upstream leading edge sloped towards the media feed path and a downstream trailing edge sloped away from the media feed path.

15 Claims, 9 Drawing Sheets

SPITTOON AND METHOD FOR GUIDING PRINT MEDIA THROUGH PRINT ZONE

CROSS-REFERENCE TO RELATED APPLICATIONS

This application is a Continuation of U.S. application Ser. No. 16/141,894 filed Sep. 25, 2018, which claims the benefit of priority of U.S. Provisional Application No. 62/563,584 filed Sep. 26, 2017, the contents of which are incorporated herein by reference in their entirety.

FIELD OF THE INVENTION

This invention relates to a print engine for a color digital press. It has been developed primarily for integrating an array of print modules into a low-cost digital inkjet press suitable for short-run print jobs.

BACKGROUND OF THE INVENTION

Inkjet printers employing Memjet® technology are commercially available for a number of different printing formats, including desktop printers, digital inkjet presses and wideformat printers. Memjet® printers typically comprise one or more stationary inkjet printhead cartridges, which are user-replaceable. For example, a desktop label printer comprises a single user-replaceable multi-colored printhead cartridge, a high-speed label printer comprises a plurality of user-replaceable monochrome printhead cartridges aligned along a media feed direction, and a wideformat printer comprises a plurality of user-replaceable printhead cartridges in a staggered overlapping arrangement so as to span across a wideformat pagewidth.

U.S. application Ser. No. 15/582,998 filed 1 May 2017, the contents of which are incorporated herein by reference, describes a commercial pagewide printing system comprising an N×M two-dimensional array of print modules. Providing OEM customers with the flexibility to select the dimensions and number of printheads in an N×M array in a modular, cost-effective kit form enables access to a wider range of commercial digital printing markets that are traditionally served by offset printing systems.

Nevertheless, it is still desirable to provide relatively low-cost complete print engines for digital presses, which have minimal development costs for OEMs. Such print engines may be commercialized relatively quickly to meet the demands of common printing widths, such as A4 width digital presses.

SUMMARY OF THE INVENTION

In a first aspect, there is provided a print engine comprising:

a media support chassis having a plurality of guide rollers mounted between opposite sidewalls thereof, the plurality of guide rollers defining a media feed path;

a maintenance chassis pivotally mounted on the media support chassis, the maintenance chassis comprising a plurality of maintenance modules fixedly mounted thereto and aligned along the media feed path; and a print bar chassis movably mounted on the maintenance chassis, the print bar chassis comprising a plurality of print modules, each print module having a printhead;

a pivot actuation mechanism for pivoting the maintenance chassis between an open and closed position; and a lift mechanism for raising and lowering the print bar chassis relative to the maintenance chassis between a maintenance position a printing position.

Preferably, the media feed path is curved and a lower surface of the maintenance chassis follows a curvature of the media feed path.

Preferably, the media support chassis comprises a plurality of spittoons, each spittoon being positioned between a neighboring pair of guide rollers and wherein the printheads each oppose a respective spittoon.

Preferably, each spittoon has an upper guide portion at least partially intersecting a common tangential plane defined between a neighboring pair of guide rollers, such that print media fed along the curved media path contact the guide rollers and upper guide portions of the spittoons.

Preferably, each printhead extends and retracts through a space defined by a corresponding maintenance module in the printing and maintenance positions, respectively.

Preferably, each maintenance module extends alongside only one longitudinal side of a respective printhead.

Preferably, each maintenance module has a generally L-shaped frame, wherein a longer leg of the frame houses a capper and a shorter leg of the frame houses a wiper.

Preferably, the maintenance chassis is mounted asymmetrically on the media support chassis.

Preferably, the maintenance chassis is pivotally mounted about a pivot shaft extending perpendicularly with respect to a media feed direction.

Preferably, the pivot shaft is positioned at one end of the print engine and a pivot actuation mechanism is engaged between the media support chassis and the maintenance chassis at an opposite end of the print engine.

In a second aspect, there is provided a print engine comprising:

a media support chassis defining a curved media feed path;

a maintenance chassis mounted on the media support chassis, the maintenance chassis having a curvature corresponding to the curved media path and comprising:

- a plurality of maintenance modules fixedly mounted between sidewalls of the maintenance chassis, the maintenance modules being aligned along the media feed path; and
- a plurality of guide rails extending radially upwards from the maintenance chassis, each maintenance module having respective parallel first and second guide rails associated therewith at opposite ends thereof;

a plurality of print module carriers, each print module carrier being slidingly received on respective parallel first and second guide rails;

a plurality of print modules, each print module being releasably engaged with a respective one of the print module carriers; and a lift mechanism for radially raising and lowering the plurality of print module carriers relative to the maintenance chassis between a maintenance position a printing position.

Preferably, a printhead of each print module extends and retracts through a space defined by a corresponding maintenance module in the printing and maintenance positions, respectively.

Preferably, the plurality of print module carriers are mounted on a print bar chassis.

Preferably, the lift mechanism is engaged between the maintenance chassis and the print bar chassis.

Preferably, the lift mechanism comprises a scissor lift.

Preferably, each print module carrier comprises a roller bearing engaged with an upper surface of the print bar chassis.

Preferably, the upper surface of the print bar chassis follows a curvature of the media feed path.

Preferably, the roller bearing bears along the upper surface during lifting of the print bar chassis to allow radial motion of the print module carriers relative to the maintenance chassis.

Preferably, each print module carrier comprises a sleeve for receiving a respective print module and a pair of mounting arms extending laterally from the sleeve.

Preferably, each mounting arm comprises a slider bracket for sliding engagement with a respective guide rail.

Preferably, the print module carrier is asymmetric having one mounting arm extending laterally further from the sleeve than the other.

Preferably, a longer mounting arm bridges over part of a respective maintenance module in the printing position.

Preferably, the longer mounting arm bridges over a wiper parked laterally with respect to the print module in the printing position.

In a third aspect, there is provided a print engine comprising:

a media support chassis having a plurality of guide rollers mounted between opposite sidewalls thereof, the plurality of guide rollers defining a curved media feed path;

a plurality of spittoons, each spittoon being positioned between a neighboring pair of guide rollers and each spittoon having an upper guide portion; and a plurality of printheads, each printhead opposing a respective spittoon, wherein the upper guide portion at least partially intersects a common tangential plane defined between a neighboring pair of rollers, such that print media fed along the curved media path contact the rollers and upper guide portions of the spittoons.

Preferably, each spittoon is height-adjustable.

Preferably, the upper guide portion of each spittoon comprises an upstream leading edge sloped towards the media feed path and a downstream trailing edge sloped away from the media feed path.

Preferably, a spittoon pit is positioned between the leading and trailing edges.

Preferably, a maintenance chassis is mounted on the media support chassis.

Preferably, the maintenance chassis comprises a plurality of fixedly mounted maintenance modules.

Preferably, a print bar chassis is movably mounted on the maintenance chassis.

Preferably, the print bar chassis comprises a plurality of print modules, each print modules comprising a respective one of the printheads.

Preferably, each printhead extends and retracts through a space defined by a respective maintenance module into printing position proximally opposed a respective spittoon and a maintenance position distally opposed the respective spittoon.

In a fourth aspect, there is provided a print module comprising a printhead cartridge releasably engaged with a supply module, wherein the supply module comprises:

a body housing electronic circuitry for supplying power and data to a printhead of the printhead cartridge; and an ink inlet module and an ink outlet module positioned on opposite external sidewalls of the body and flanking the body, each of the ink inlet and ink outlet modules having a respective ink coupling engaged with complementary inlet and outlet couplings of the printhead cartridge.

wherein the ink inlet and outlet modules each comprise a respective lever mechanism for slidably moving the ink inlet and outlet modules relative to the opposite external sidewalls of the body between a coupled position in which the supply module is fluidically coupled to the printhead cartridge and a decoupled position in which the supply module is fluidically decoupled from the printhead cartridge.

Preferably, each lever mechanism comprises a lever having an axis of rotation perpendicular to a length dimension of the print module and parallel to a width dimension of the print module.

Preferably, each lever mechanism comprises a lever operatively connected to a pinion and a fixed rack engaged with the pinion.

In a further aspect, there is provided a method of coupling a printhead cartridge with a supply module, the supply module comprising a body housing electronic circuitry for supplying power and data signals to the printhead cartridge; and an ink inlet module and an ink outlet module positioned on external opposite sidewalls of the body and flanking the body, each of the ink inlet and outlet modules having a respective ink coupling, the method comprising the steps of:

positioning the printhead cartridge relative to the supply module so as to align the ink inlet and ink outlet couplings of the supply module with complementary inlet and outlet couplings at each end of the printhead cartridge;

actuating a first lever mechanism so as to slide the ink inlet module relative to one external sidewall of the body and engage the ink coupling of the ink inlet module with the complementary inlet coupling of the printhead cartridge; and actuating a second lever mechanism so as to slide the ink outlet module relative to an opposite external sidewall of the body and engage the ink coupling of the ink outlet module with the complementary outlet coupling of the printhead cartridge.

Preferably, each of the first and second lever mechanisms comprises a lever having an axis of rotation perpendicular to a length dimension of the supply module and parallel to a width dimension of the supply module.

Preferably, each of the first and second lever mechanisms comprises a lever operatively connected to a pinion and a fixed rack engaged with the pinion.

As used herein, the term "ink" is taken to mean any printing fluid, which may be printed from an inkjet printhead. The ink may or may not contain a colorant. Accordingly, the term "ink" may include conventional dye-based or pigment based inks, infrared inks, fixatives (e.g. pre-coats and finishers), 3D printing fluids and the like.

As used herein, the term "mounted" includes both direct mounting and indirect mounting via an intervening part.

BRIEF DESCRIPTION OF THE DRAWINGS

Embodiments of the present invention will now be described by way of example only with reference to the accompanying drawings, in which.

DETAILED DESCRIPTION OF THE INVENTION

Print Engine

Figure 1:
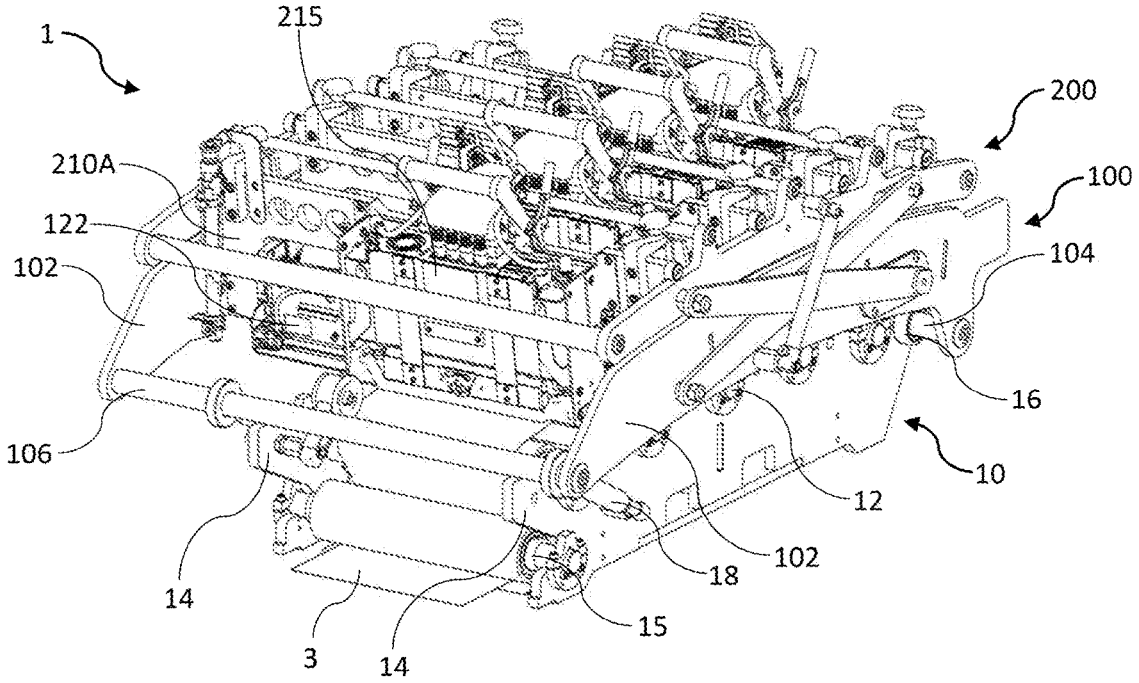
FIG. 1 is a perspective view of a print engine in a printing position
Figure 2:
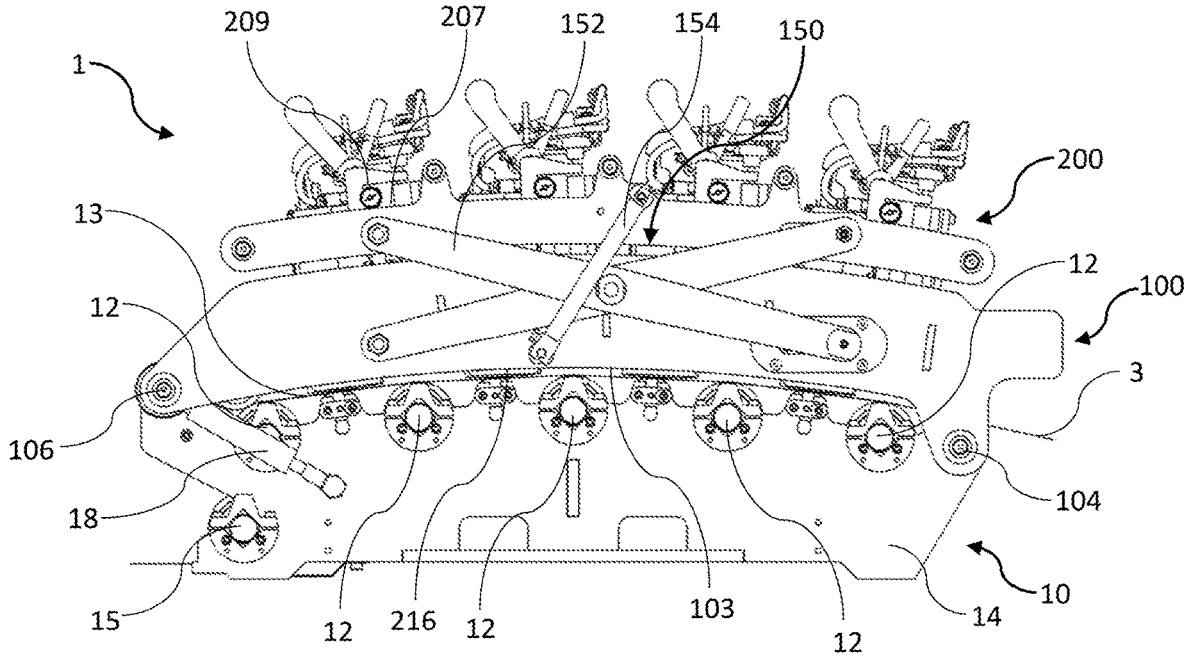
FIG. 2 is a side view of the print engine in the printing position.
Figure 3:
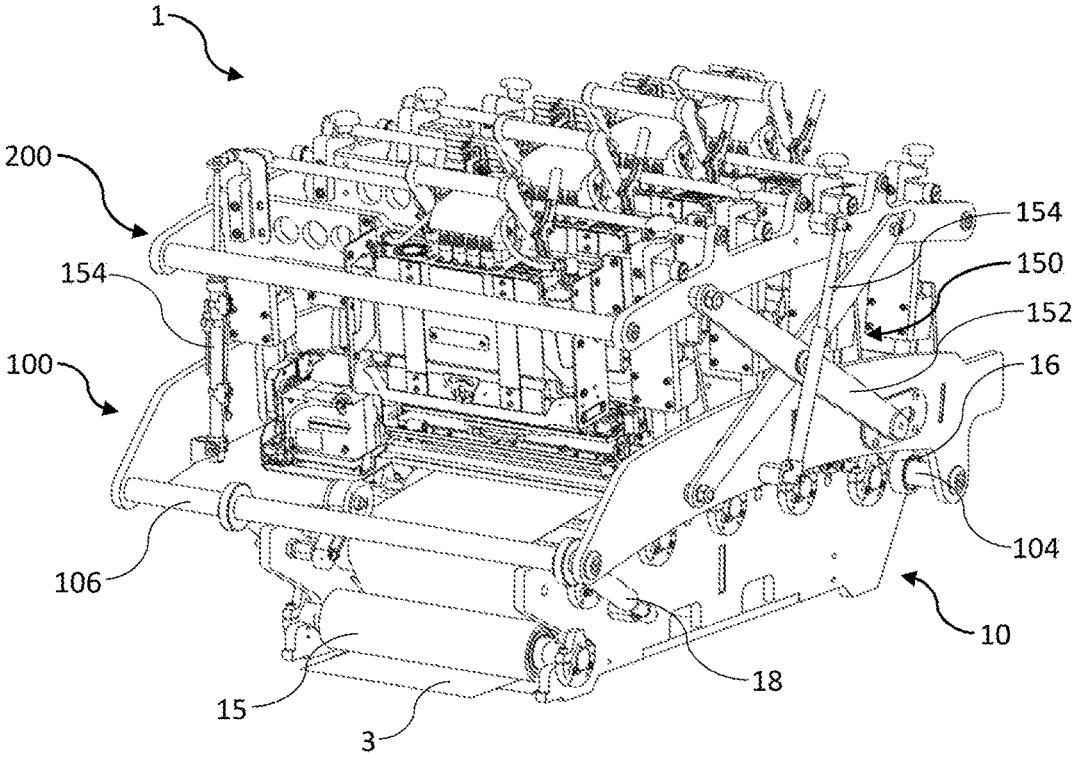
FIG. 3 is a perspective view of the print engine in a maintenance position.

Referring to FIGS. 1 to 4, there is shown a print engine 1 for full-color printing onto a media web 3. The print engine 1 is designed for OEM-customization into digital inkjet presses meeting individual customers' requirements. The print engine 1 comprises a media support chassis 10 having a set of five guide rollers 12 rotatably mounted between opposite support chassis side plates 14. The guide rollers 12 are arranged so as to define a curved (convex) media feed path 13, which is optimal for tensioning the media web 3 over the guide rollers. A media feed mechanism, such as those typically used in conventional offset presses (not shown), may be used for feeding the media web 3 towards an input roller 15 positioned below the set of five guide rollers 12 and then away from the print engine 1 under suitable tension.

Figure 6:
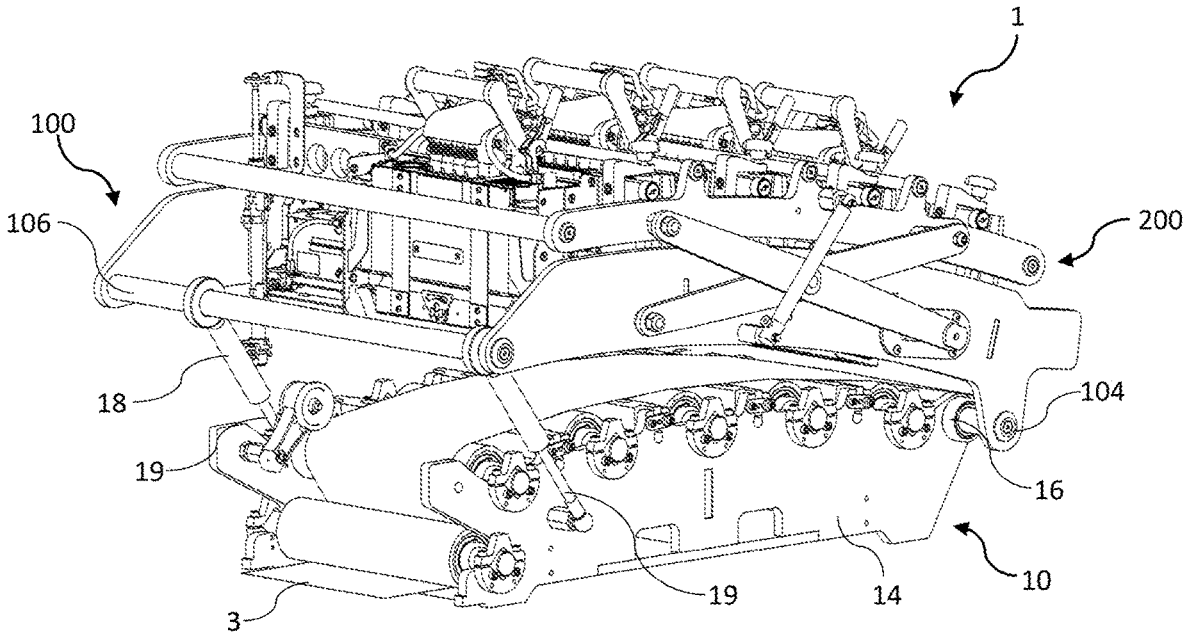
FIG. 6 is a perspective view of the print engine in an open position.
Figure 7:
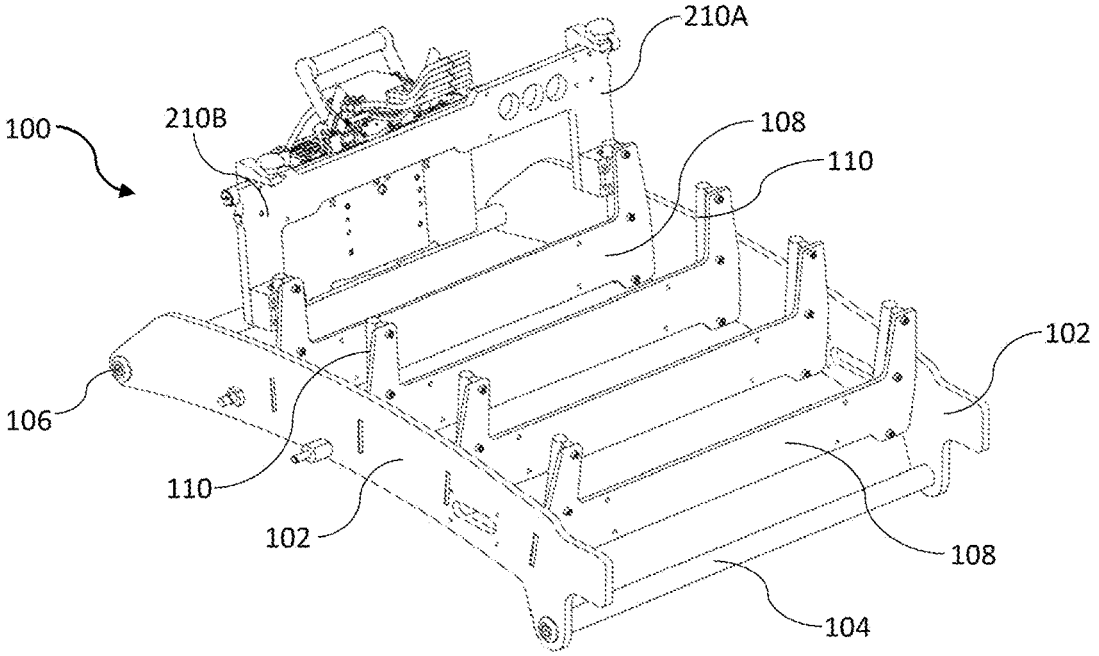
FIG. 7 is a perspective view of the maintenance chassis and a print module carriage assembly with all maintenance modules removed.

A maintenance chassis 100 is mounted on the media support chassis 10 and comprises a pair of opposed maintenance chassis side plates 102 having respective lower surfaces 103 which generally follow the curvature of the media feed path 13. The opposed maintenance chassis side plates 102 are connected at opposite ends via a first shaft 104 and a second shaft 106. The first shaft 104 is received in respective bearings 16 of the support chassis side plates 14 and defines a pivot axis for the maintenance chassis 100 relative to the media support chassis 10. This mounting arrangement allows the maintenance chassis 100 to pivot between a closed position (FIGS. 1 to 4) and an open position (FIG. 6). In the open position, the guide rollers 12 and media web 3 are readily accessible, which allows the media web 3 to be threaded through the print engine 1. Pivoting of the maintenance chassis 100 is actuated by a pair of piston mechanisms 18 linking the media support chassis 10 to the second shaft 106 of the maintenance chassis. Actuation of the piston mechanism 18 extends a piston rod 19, which pivots the maintenance chassis 100 away from the media support chassis 10 into the open position shown in FIG. 6.

Between the first and second shafts 104 and 106, the maintenance chassis side plates 102 are interconnected via four fixed brace plates 108 spaced apart along the length of the maintenance chassis 100. Each brace plate 108 provides structural rigidity to the maintenance chassis 100 and serves as a mounting bracket for mounting of a respective maintenance module 115. (The maintenance modules 115 are described in further detail below in connection with FIGS. 15 and 16). In addition, each brace plate 108 includes a pair of parallel guide rails 110, one at each end of a respective brace plate, for slidably mounting a print module carrier 202. The brace plates 108 are arranged radially and the four pairs of parallel guide rails 110 associated with the four brace plates 108, likewise, extend radially outwards with respective to the curved media path 13.

Figure 9:
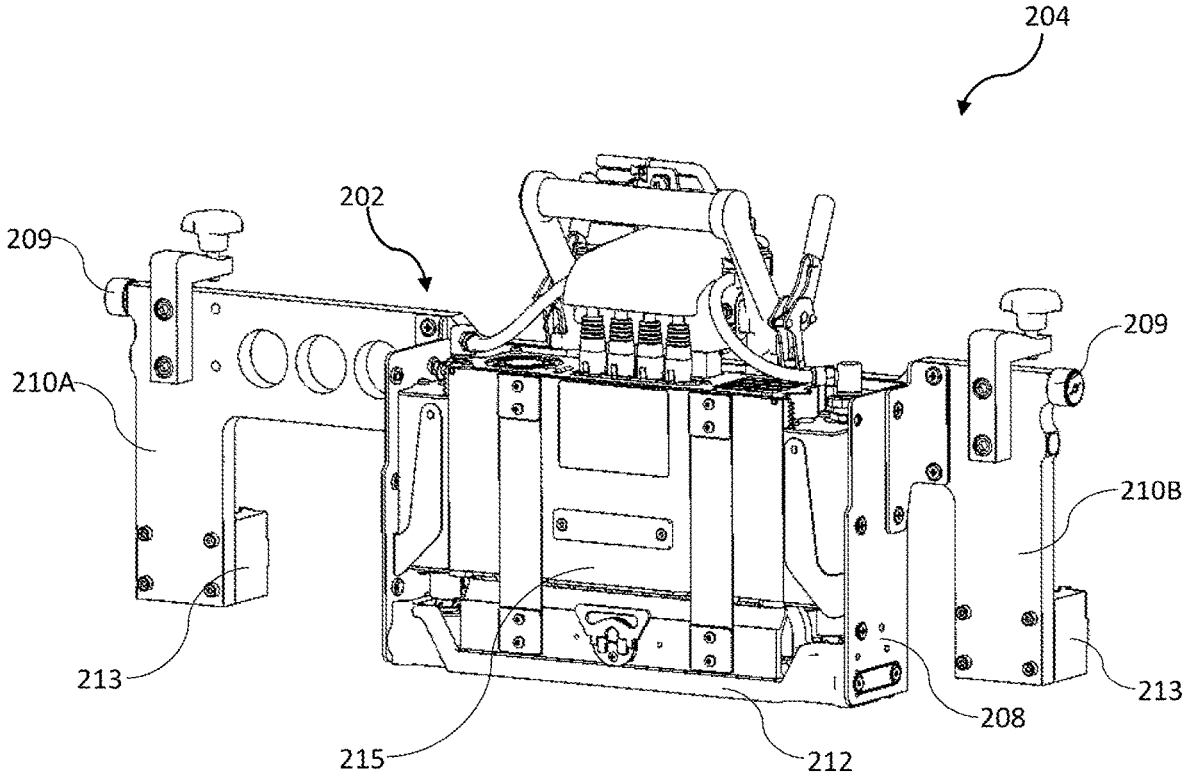
FIG. 9 is a perspective view of a print module carriage assembly.

As best shown in FIG. 9, a print module carriage assembly 204 comprises a print module 215 securely and releasably engaged with a print module carrier 202. The print module carrier 202 comprises a sleeve 208 in which the print module 215 is slidably received and a pair of mounting arms 210A and 210B extending laterally from either side of the sleeve. The sleeve 208 comprises a printhead nest 212 at a base thereof, which functions as a datum for the print module 215 relative to the print module carrier 202. Each of the mounting arms 210A and 210B comprises a respective slider bracket 213 configured for sliding engagement with one of the guide rails 110 of the maintenance chassis 100. Hence, each print module carrier 202 is slidably engaged with one pair of parallel guide rails 110 via its respective slider brackets 213. In this way, the print module 215 is able to move up and down relative to the maintenance chassis 100 and the media feed path 13.

In the print engine 1 shown in the Figures, there are four monochrome print modules 215 (cyan, magenta, yellow and black for full-color printing), each mounted on a respective print module carrier 202 and each having a respective printhead 216. However, it will be appreciated that the print engine may accommodate any number of print modules 215, as required, with a corresponding number of maintenance modules 115.

Figure 4:
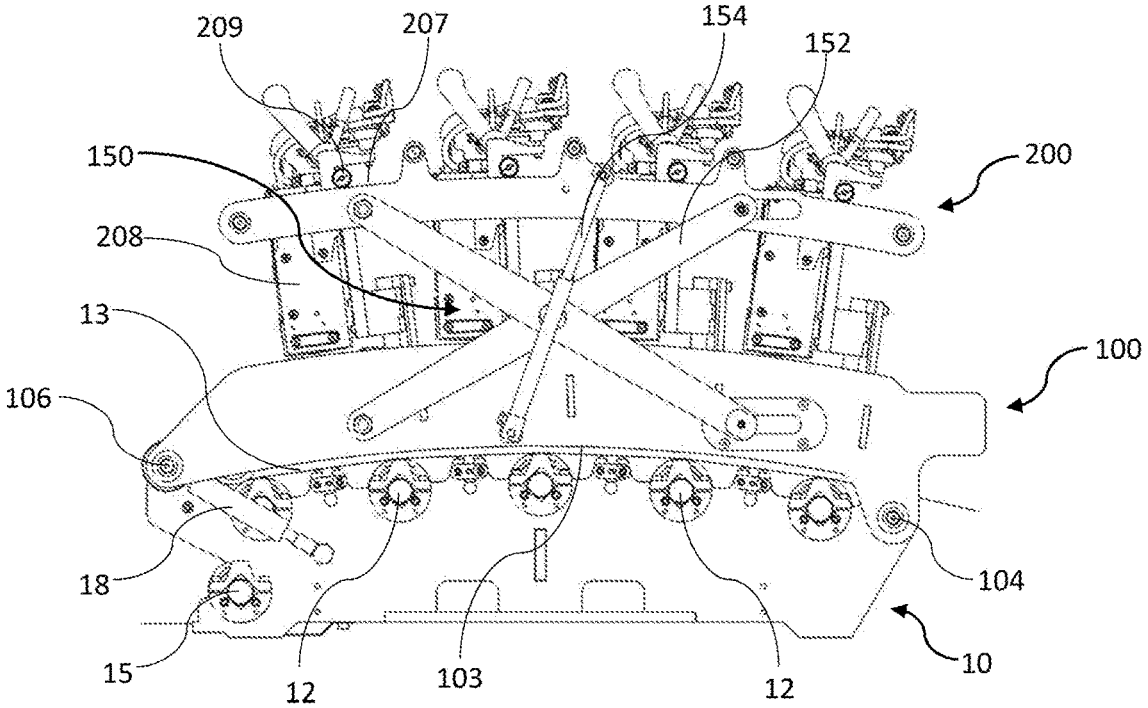
FIG. 4 is a side view of the print engine in the maintenance position.
Figure 5:
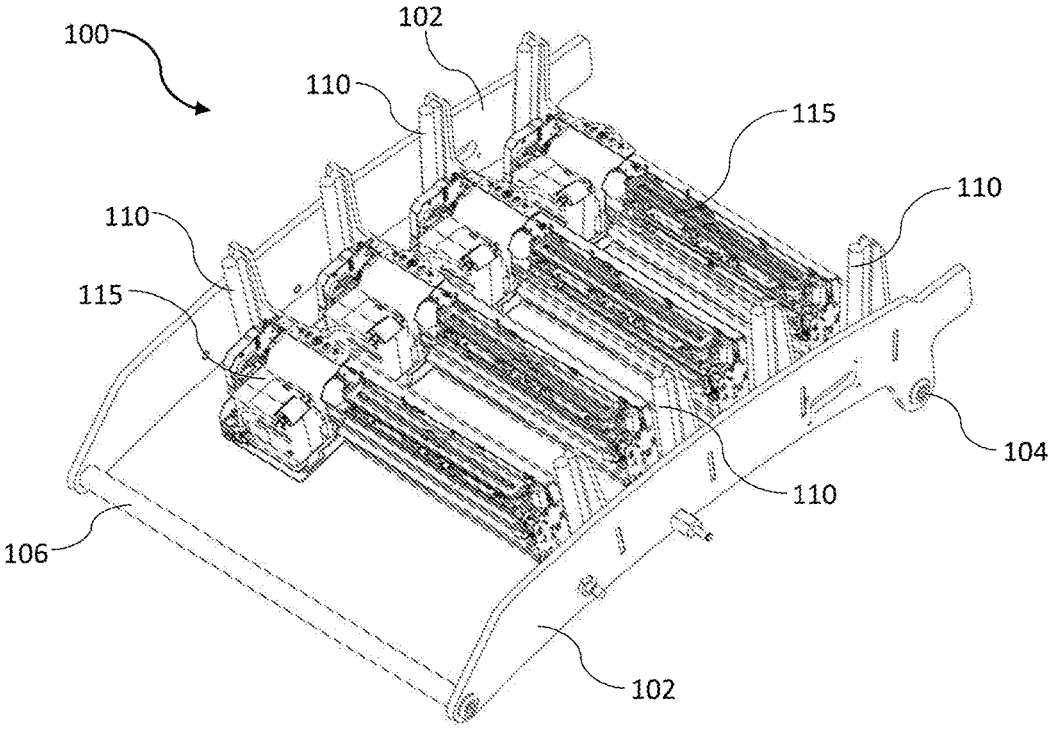
FIG. 5 is a perspective view of a maintenance chassis.
Figure 8:
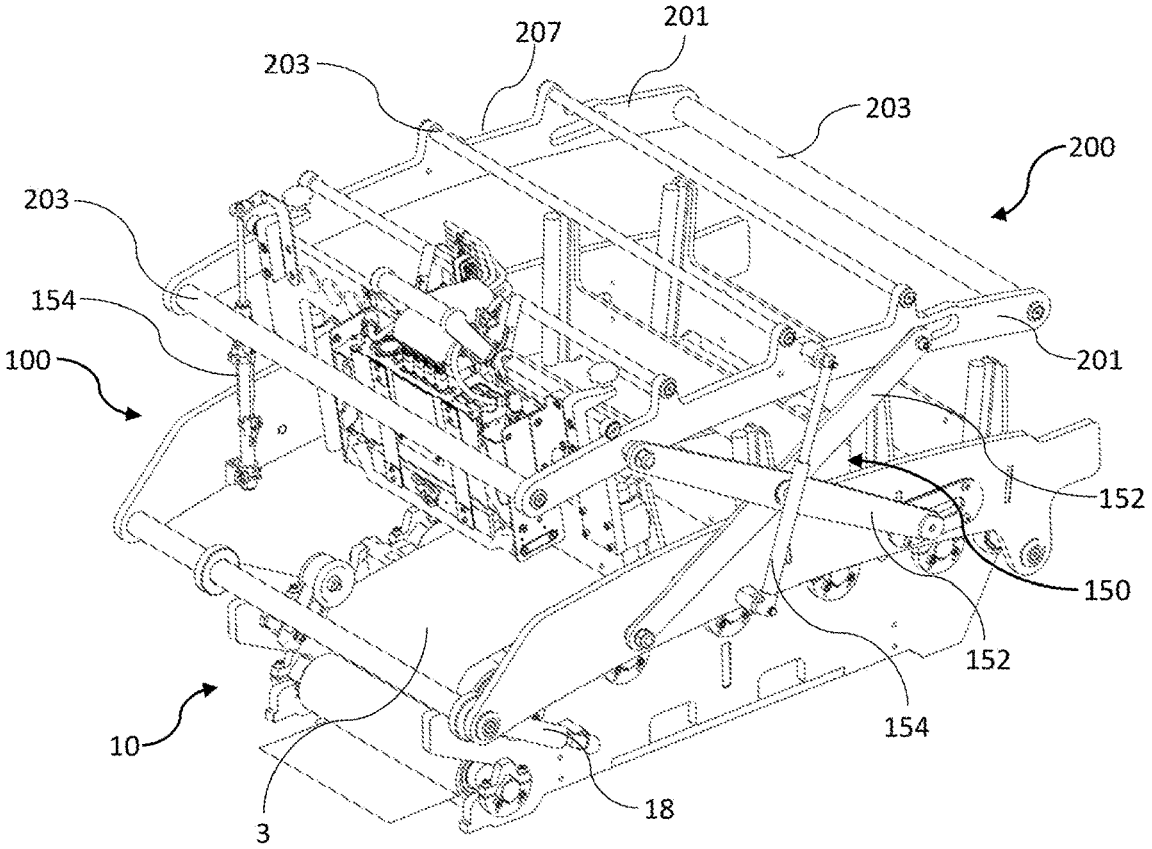
FIG. 8 is a perspective view of the print engine with all maintenance modules and all but one print module carriage assemblies removed.

The four print module carriers 202 are mounted on a print bar chassis 200, which is movably mounted on the maintenance chassis 100. As best shown in FIG. 8, the print bar chassis 200 comprises a pair of opposed print bar chassis side plates 201 connected via a plurality of brace rods 203 extending therebetween. An upper surface 207 of each print bar chassis side plate 201 has a curvature following the curvature of the media feed path 13. The upper surfaces 207 define bearing surfaces for roller bearings 209 mounted at opposite ends of each print module carrier 202. Each print module carrier 202 is engaged with the print bar chassis 200 via its pair of roller bearings 209 seated on respective upper surfaces 207 of the print bar chassis side plates 201. A scissor lift mechanism 150, comprising pivoted scissor arms 152 and piston actuators 154, is engaged between the print bar chassis 200 and the maintenance chassis 100 for raising and lowering the print bar chassis relative to the maintenance chassis. Actuation of the scissor lift mechanism 150 thereby exerts an upward force on the roller bearings 209, which lifts the four print module carriers 202 slidingly up the guide rails 110 from a printing position (FIG. 2) to a maintenance position (FIG. 4). Radial motion of the print module carriers 202 is accommodated by means of the roller bearings 209 rolling across the upper surface 207 of the print bar chassis 200 during lifting. Comparing FIGS. 2 and 4, it can be seen for example that the leftmost roller bearing 209 has moved towards the left during lifting to provide the required radial motion of the print module carrier 202 relative to the media feed path 13. Hence, the vertical lifting motion of the print bar chassis 200 is transformed into generally upwards radial motion of the print modules 215.

Figure 10:
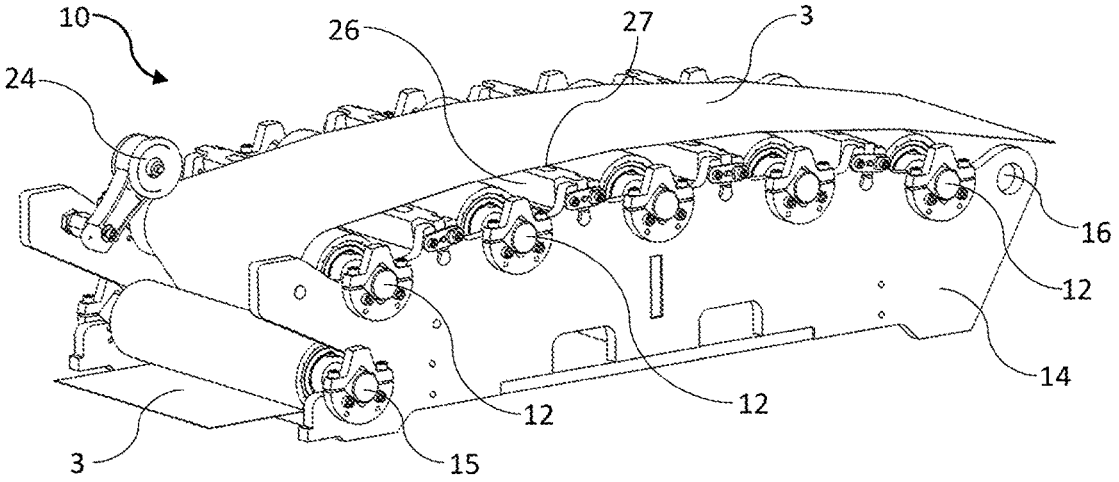
FIG. 10 is a perspective view of a media support chassis.
Figure 11:
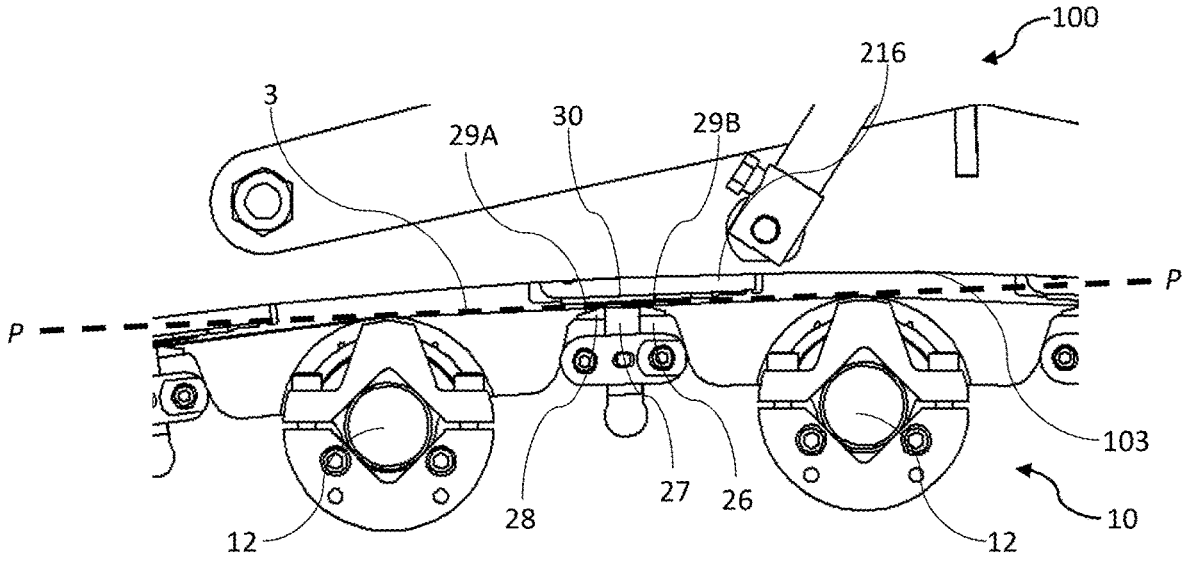
FIG. 11 is magnified view of a spittoon between neighboring guide rollers.

Referring to FIGS. 10 and 11, during printing, the media web 3 is fed along the convexly curved media feed path 13 over the plurality of guide rollers 12. An encoder wheel 24 is engaged with an upper surface of the media web 3 between the input roller 15 and the guide roller 12 positioned furthest upstream in the media support chassis 10. The encoder wheel monitors the speed of the media web 3 through the print engine 1 and provides a timing signal for each of the print modules 215 to control ink ejection. A spittoon 26 is positioned interstitially between each neighboring pair of guide rollers 12 and each printhead 216 of a respective print module 215 is positioned opposite a respective spittoon. Conventionally, the spittoons 26 each have a central spittoon pit 27, optionally containing an absorbent material, for receiving ink droplets. Referring now to FIG. 11, an upper guide part 28 of each spittoon 26 is positioned to intersect a common tangential plane P between a neighboring pair of guide rollers 12, such that the upper guide part 28 contacts a lower surface of the media web 3. The upper guide part 28 is profiled with a leading edge 29A sloped towards the media web 3 and a trailing edge 29B sloped away from the media web. Therefore, the upper guide part 28 assists in guiding the media web 3 through the media feed path 13 between the rollers 12. In particular, each upper guide part 28 assists in minimizing flutter and stabilizing the media web 3 it passes through each of the four print zones 30. The spittoons 26 may be height-adjustable for configuring the print engine 1 to achieve optimal print quality.

Maintenance Module

The maintenance modules 115 are generally as described in the Applicant's U.S. application Ser. No. 15/583,006 filed 1 May 2017, entitled "Printer having L-shaped maintenance modules for a plurality of printheads", the contents of which are incorporated herein by reference.

As shown in FIGS. 1 to 4, the maintenance chassis 100 supports four maintenance modules 115, one for each of the four print modules 215. The maintenance modules 115 are fixedly mounted to the maintenance chassis 100, and each defines a space or opening through which a respective print module 215 can extend and retract between the printing position (FIGS. 1 and 2) and the maintenance position (FIGS. 3 and 4), respectively. Accordingly, in the printing position, each printhead 216 is positioned at a suitable spacing from the media web and protrudes somewhat below the lower surface of the maintenance chassis 100 (see FIG. 11).

Figure 15:
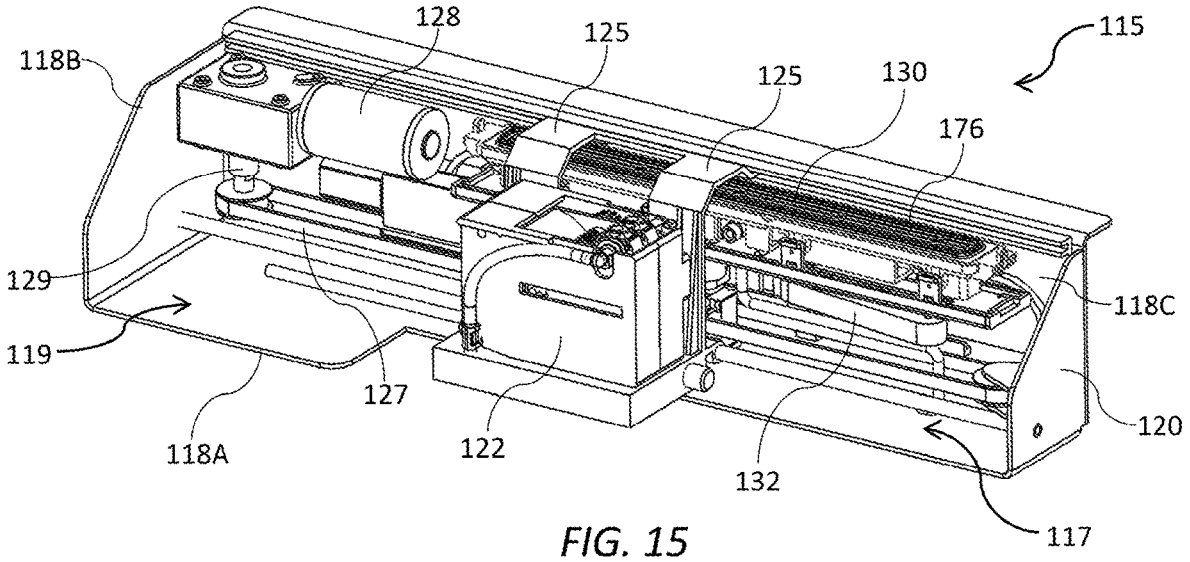
FIG. 15 is a perspective view of a maintenance module during wiping.
Figure 16:
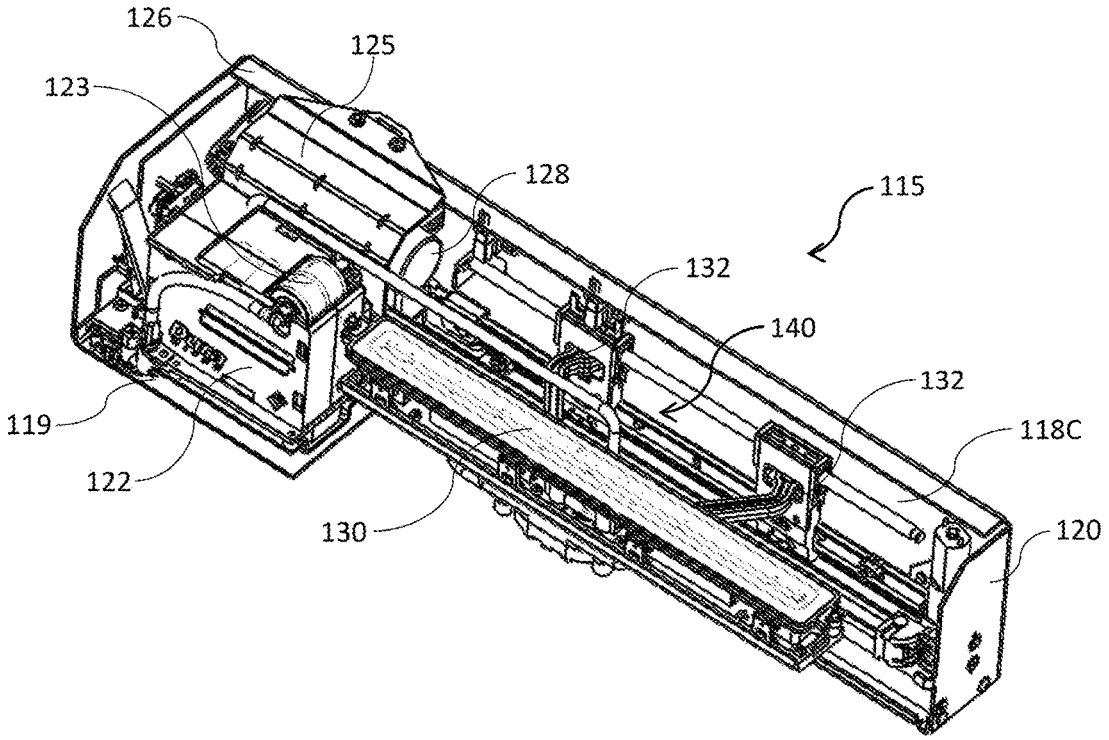
FIG. 16 is a perspective view of a maintenance module during capping.

Referring to FIGS. 15 and 16, each maintenance module 115 has a generally L-shaped frame 120, which is arranged to wrap around two sides of its respective print module 215. The L-shaped frame 120 has a longer leg 117 extending parallel with one length dimension of the print module 215 and one shorter leg 119 extending parallel with a width dimension of the print module. The L-shaped frame 120 of each maintenance module 115 enables a compact arrangement of the maintenance modules.

The L-shaped frame 120 of the maintenance module 115 comprises a base plate 118A with a shorter side plate 118B and a longer side plate 118C extending upwards therefrom. The shorter leg 119 comprises the shorter side plate 118B and a corresponding part of the base plate 118A; the longer leg 117 comprises the longer side plate 118C and a corresponding part of the base plate 118A. The L-shaped frame 120 houses a wiper 122 for wiping a respective printhead 216 and a capper 130 for capping the printhead.

As shown in FIG. 15, the wiper 122 is in its home or parked position, whereby the wiper is positioned within the shorter leg 119 of the L-shaped frame 120. As shown in FIG. 10, the capper 130 is in its home or parked position, whereby the capper is positioned within the longer leg 117 of the L-shaped frame 120.

The wiper 122 is of a type having a wiping material 123 (shown in FIG. 16) mounted on a carriage 124, which moves longitudinally along a length of the print module 215 to wipe the printhead 216. The carriage 124 is supported by one or more overhead arms 125, which are slidingly engaged in a carriage rail 126 fixed to the longer side plate 118C and extending along the longer arm 119 of the frame 120. In FIG. 10, the carriage 124 has moved from its home position and is partway through a longitudinal wiping operation. In FIG. 15, the capper is in its parked position and it can be seen that the overhead arms 125 bridge over the capper 130 during the wiping movement of the carriage 124. The carriage 124 is traversed by means of a first endless belt 127 driven by a bidirectional carriage motor 128 and belt drive mechanism 129. Printhead wipers of the type having a carriage carrying a web of wiping material are described in, for example, U.S. Pat. No. 4,928,120.

The capper 130 is mounted to the longer side plate 118C of the L-shaped frame 120 via a pair of hinged arms 132, which laterally extend and retract the capper into and away from a space occupied by the printhead 216 by means of a suitable retraction mechanism 140, such as those described in U.S. application Ser. No. 15/583,006. The capper 130 is shown in its capping position in FIG. 16 with both arms 132 extended, while the wiper 122 is parked in its home position.

For capping operations, the print bar chassis 200 is lifted from the maintenance chassis 100 and raised initially into a transition position. With the print bar chassis 200 in its highest transition position, each capper 130 is extended, and the print bar chassis 200 then gently lowered to the maintenance position such that the each printhead 216 is capped by a perimeter seal 176 of its respective capper. The reverse process configures the print engine 1 back into the printing position.

Similarly, for wiping operations, the print bar chassis 200 is lifted from the maintenance chassis 100 and raised initially into a transition position. With the print bar chassis 200 in its highest transition position, each wiper 122 is moved beneath its respective printhead 216 and the print bar gently lowered into the maintenance position so that the wipers are engaged with their respective printheads. Typically, the wiping material 123 is resiliently mounted to allow a generous tolerance when the print bar chassis 200 is lowered. Once the wiper 122 engaged with the printhead 216, the carriage 124 is traversed lengthwise along the printhead to wipe ink and/or debris from the nozzle surface of the printhead.

Returning briefly to FIG. 9, the print module carrier 202 is asymmetric having the sleeve 208 positioned non-centrally and one mounting arm 210A being relatively longer, in a laterally sense relative to the sleeve, than the other mounting arm 210B. This asymmetric configuration allows the print module carrier 202 to be lowered over the wiper 122 in the printing position (FIG. 1) with the longer mounting arm 210A bridging over the laterally parked wiper. The maintenance chassis 100 and print bar chassis 200 are correspondingly positioned asymmetrically with respect to the media support chassis 10 to allow each wiper 122 to be parked laterally with respect to the print module 215 in the printing position.

Print Module

Figure 12:
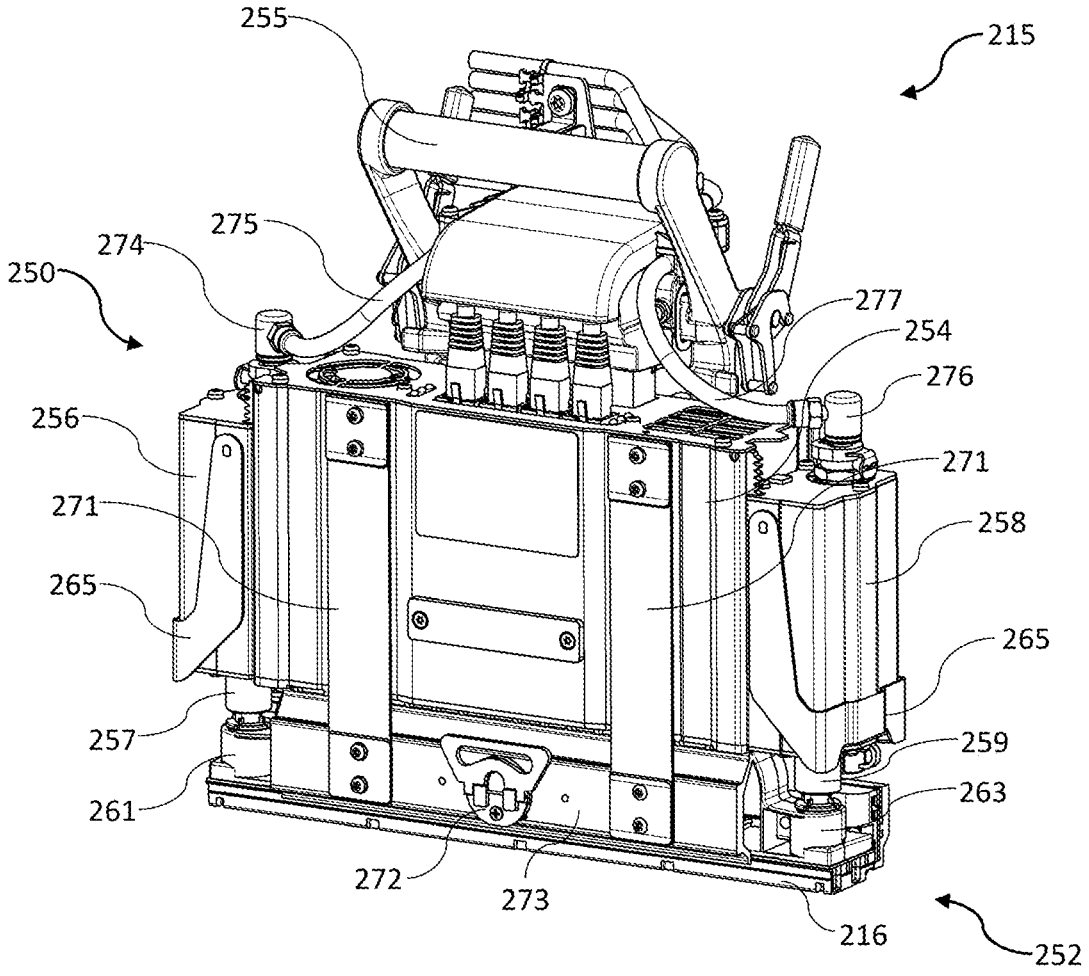
FIG. 12 is a perspective view of a print module.

The print module 215 will now be described in further detail with reference to FIGS. 12 to 14. The print module 215 comprises a supply module 250 engaged with a replaceable printhead cartridge 252, which includes the printhead 216. The printhead cartridge 252 may be of a type described in, for example, the Applicant's U.S. application Ser. No. 15/583,099 filed 1 May 2017, the contents of which are incorporated herein by reference.

The supply module 250 comprises a body 254 housing electronic circuitry for supplying power and data to the printhead 216. A handle 255 extends from an upper part of the body 254 to facilitate user removal and insertion into one of the sleeves 208 of the print bar chassis 200.

The body 254 is flanked by an ink inlet module 256 and an ink outlet module 258 positioned on opposite sidewalls of the body. Each of the ink inlet and ink outlet modules has a respective ink coupling 257 and 259 engaged with complementary inlet and outlet couplings 261 and 263 of the printhead cartridge 252. The printhead cartridge 252 is supplied with ink from an ink delivery system (not shown) via the ink inlet module 256 and circulates the ink back to the ink delivery system via the ink outlet module 258.

The ink inlet module 256 and ink outlet module 258 are each independently slidably movable relative to the body 254 towards and away from the printhead cartridge 252. Sliding movement of the ink inlet and outlet modules 256 and 258 enables fluidic coupling and decoupling of the printhead cartridge 252 from the supply module 250. Each of the ink inlet and outlet modules 256 and 258 has a respective actuator in the form of a lever 265, which actuates sliding movement of the modules. Each lever 265 rotates about an axis perpendicular to the printhead 216 and is operatively connected to a pair of pinions 281. Rotation of the pinions 281 causes lateral sliding of movement of the inlet and outlet modules 256 and 258 relative to the body 254 via engagement with complementary racks 283 extending upwards and fixedly mounted relative to the body. This lever arrangement minimizes the overall width of the print module 215. As shown in FIGS. 12 and 14, the ink inlet module 256 and ink outlet module 258 are both lowered and the printhead cartridge 252 is fluidically coupled to the supply module 250. As shown in FIG. 13, the ink inlet and outlet modules 256 and 258 are both raised and the printhead cartridge 252 is fluidically decoupled from the supply module 250.

Figure 13:
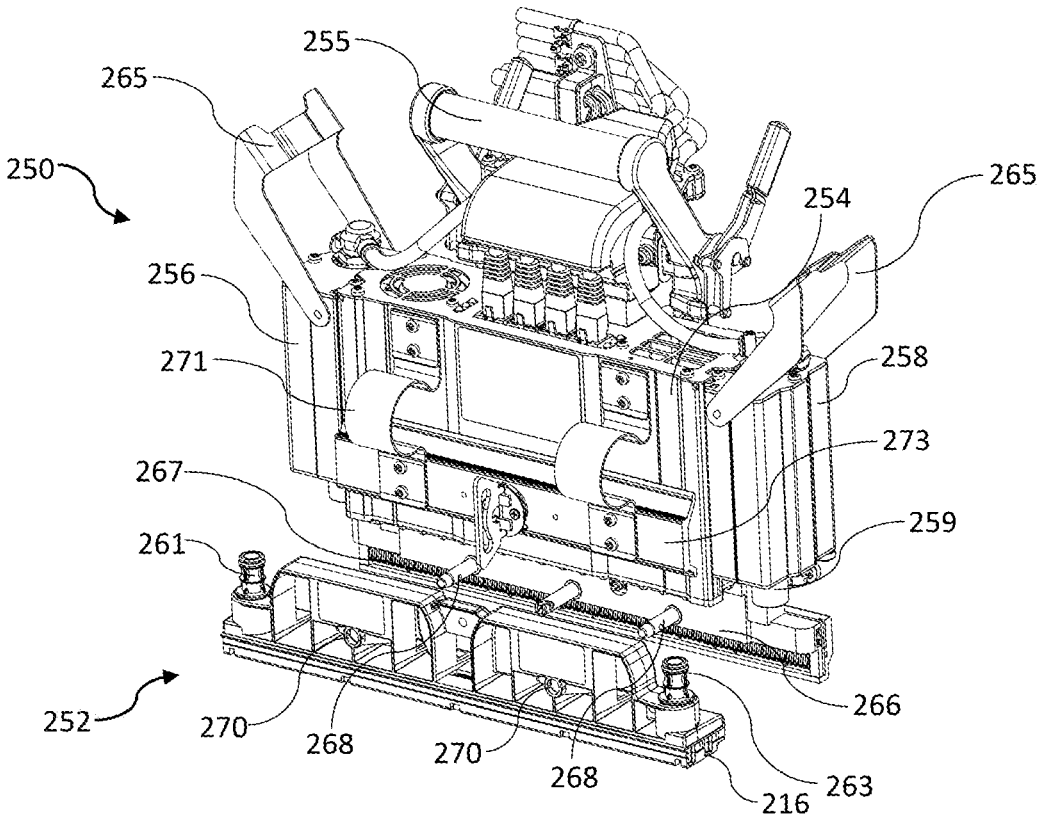
FIG. 13 is a perspective view of the print module with a printhead cartridge being decoupled.
Figure 14:
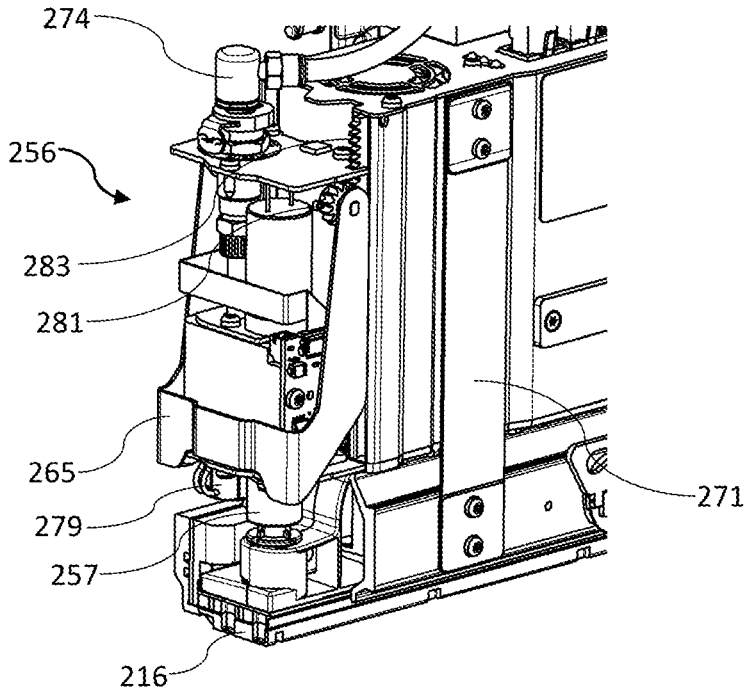
FIG. 14 shows an ink inlet module of the print module.

Still referring to FIG. 13, the supply module 250 has a clamp plate 266 extending from a lower part of the body 254. The lower part of the body 254 additionally has a row of electrical contacts 267 for supplying power and data to the printhead 216 via a complementary row of contacts (not shown) on the printhead cartridge 252 when the printhead cartridge is coupled to the supply module 250.

A set of locating pins 268 extend from the clamp plate 266 perpendicularly with respect to a sliding movement direction of the ink inlet and outlet modules 256 and 258. In order to install the printhead cartridge 252, each locating pin 268 is aligned with and received in a complementary opening 270 defined in the printhead cartridge 252. The printhead cartridge 252 is slid in the direction of the locating pins 268 towards the clamp plate 266. Once the printhead cartridge 252 is engaged with the clamp plate 266, a hinged clamp 273, connected to the body 254 via hinges 271, is swung downwards to clamp the printhead cartridge 252 against the clamp plate. The printhead cartridge 252 is locked in place by a fastener 272 on the hinged clamp 273. Finally, the ink inlet and outlet modules 256 and 258 are slid downwards via actuation of the levers 265 to fluidically couple the printhead cartridge 252 to the supply module 250. The reverse process is used to remove the printhead cartridge 252 from the supply module 252. The manual removal and insertion process, as described, can be readily and cleanly performed by users within a matter of minutes and with minimal loss of downtime in a digital press.

The ink supply module 256 is configured for receiving ink at a regulated pressure from an inlet line of an ink delivery system (not shown). A suitable ink delivery system for use in connection with the print modules 215 employed in the present invention is described in the Applicant's U.S. application Ser. No. 15/582,979, the contents of which are incorporated herein by reference. The ink inlet module 256 has an inlet port 274 for receiving ink from an ink reservoir (not shown) via an inlet line 275, while the ink outlet module 258 has an outlet port 276 for returning ink to the ink reservoir via an outlet line 277.

The ink inlet and outlet modules 256 and 258 independently house various components for providing local pressure regulation at the printhead 216, dampening ink pressure fluctuations, enabling printhead priming and de-priming operations, isolating the printhead for transport etc. In FIG. 14, the ink inlet module 256 is shown with a cover removed to reveal certain components of the ink inlet module. For example, there is shown a control PCB 278 having an ink pressure sensor and a microprocessor, which provides feedback to a control valve 279 for controlling a local pressure at the printhead 216. It will be appreciated that these and other components may be housed in the ink inlet and outlet modules 256 and 258.

From the foregoing, it will appreciated that the present invention enables print modules 215 and maintenance modules 115 to be arranged in a relatively low-cost, full-color print engine 1, which minimizes integration, development and commercialization costs for OEMs.

It will, of course, be appreciated that the present invention has been described by way of example only and that modifications of detail may be made within the scope of the invention, which is defined in the accompanying claims.

The invention claimed is:

1. A print engine comprising:

a media support chassis having a plurality of guide rollers mounted between opposite sidewalls thereof, the plurality of guide rollers defining a curved media feed path;

a plurality of spittoons, each spittoon being positioned between a neighboring pair of guide rollers and each spittoon having an upper guide portion for guiding print media; and a plurality of printheads, each printhead opposing a respective spittoon, wherein the upper guide portion of each spittoon comprises an upstream leading edge sloped towards the media feed path and a downstream trailing edge sloped away from the media feed path.

2. The print engine of claim 1 wherein each spittoon is height-adjustable.

3. The print engine of claim 1, wherein a spittoon pit is positioned between the leading and trailing edges of each spittoon.

4. The print engine of claim 1, wherein a maintenance chassis is mounted on the media support chassis.

5. The print engine of claim 4, wherein the maintenance chassis comprises a plurality of fixedly mounted maintenance modules.

6. The print engine of claim 4, wherein a print bar chassis is movably mounted on the maintenance chassis.

7. The print engine of claim 6, wherein the print bar chassis comprises a plurality of print modules, each print modules comprising a respective one of the printheads.

8. The print engine of claim 7, wherein each printhead extends and retracts through a space defined by a respective maintenance module into printing position proximally opposed a respective spittoon and a maintenance position distally opposed the respective spittoon.

9. A method of stabilizing print media in a print zone, the method comprising the steps of:

feeding the print media along a media feed path between a pair of rollers and through the print zone; and guiding the print media over an upper guide portion of a spittoon positioned opposite a printhead in the print zone, wherein the spittoon comprises an upstream leading edge sloped towards the media feed path and a downstream trailing edge sloped away from the media feed path.

10. The method of claim 9, wherein the print media is a media web.

11. The method of claim 9, which minimizes flutter of the print media in the print zone.

12. The method of claim 9, wherein the upper guide portion at least partially intersects a common tangential plane defined between a the pair of rollers.

13. The method of claim 12, wherein print media contacts the rollers and upper guide portion of the spittoon.

14. The method of claim 9, wherein the media feed path is curved.

15. The method of claim 9, wherein the spittoon is height-adjustable.

* * * * *